US011673167B2

(12) United States Patent
Nayir

(10) Patent No.: US 11,673,167 B2
(45) Date of Patent: Jun. 13, 2023

(54) WIPING MOP

(71) Applicant: Die putzigen Elfen, Aschheim (DE)

(72) Inventor: Burak Nayir, Aschheim (DE)

(73) Assignee: Die putzigen Elfen, Aschheim (DE)

( * ) Notice: Subject to any disclaimer, the term of this patent is extended or adjusted under 35 U.S.C. 154(b) by 39 days.

(21) Appl. No.: 17/347,167

(22) Filed: Jun. 14, 2021

(65) Prior Publication Data

US 2021/0387236 A1 Dec. 16, 2021

(30) Foreign Application Priority Data

Jun. 15, 2020 (EP) ..... 20180101

(51) Int. Cl.

| | |
|---|---|
| ***B08B 1/00*** | (2006.01) |
| ***A47L 13/16*** | (2006.01) |
| ***A47L 13/22*** | (2006.01) |
| ***B08B 1/04*** | (2006.01) |
| ***B08B 3/14*** | (2006.01) |

(52) U.S. Cl.

CPC ..... *B08B 1/006* (2013.01); *A47L 13/16* (2013.01); *A47L 13/22* (2013.01); *B08B 1/04* (2013.01); *B08B 3/14* (2013.01); *A47L 2601/20* (2013.01)

(58) Field of Classification Search

None

See application file for complete search history.

(56) References Cited

U.S. PATENT DOCUMENTS 3,052,905 A 9/1962 McMillen et al.

FOREIGN PATENT DOCUMENTS

| | | | |
|---|---|---|---|
| DE | 19849978 | A1 | 5/2000 |
| DE | 102004014371 | A1 | 10/2005 |
| DE | 102005024745 | A1 | 8/2006 |
| DE | 102005019624 | A1 | 11/2006 |
| DE | 102015105828 | A1 | 10/2016 |

*Primary Examiner* — Eric W Golightly

(74) *Attorney, Agent, or Firm* — Hahn Loeser & Parks LLP; Bret A. Hrivnak

(57) ABSTRACT

The present invention relates to a wiping mop (10) with a housing (20), wherein an anchoring mechanism (11) for a handle (12) for guiding the wiping mop (10) is attached to the upper side of the housing. A wiping band (30) which is closed in itself is guided partially around and partially through the housing (20). On entry into the housing (20) the wiping band (30) runs through a mechanical dirt separator as well as a first (80) and a second (70) tank to be filled with wiping liquids in each case, whereby the wiping band (30) is cleaned of dirt particles taken up during use and is moistened for further wiping. Before leaving the second tank (80) the wiping band (30) is wrung out by cheeks of an outlet slot which are displaceable manually relative to one another.

17 Claims, 1 Drawing Sheet

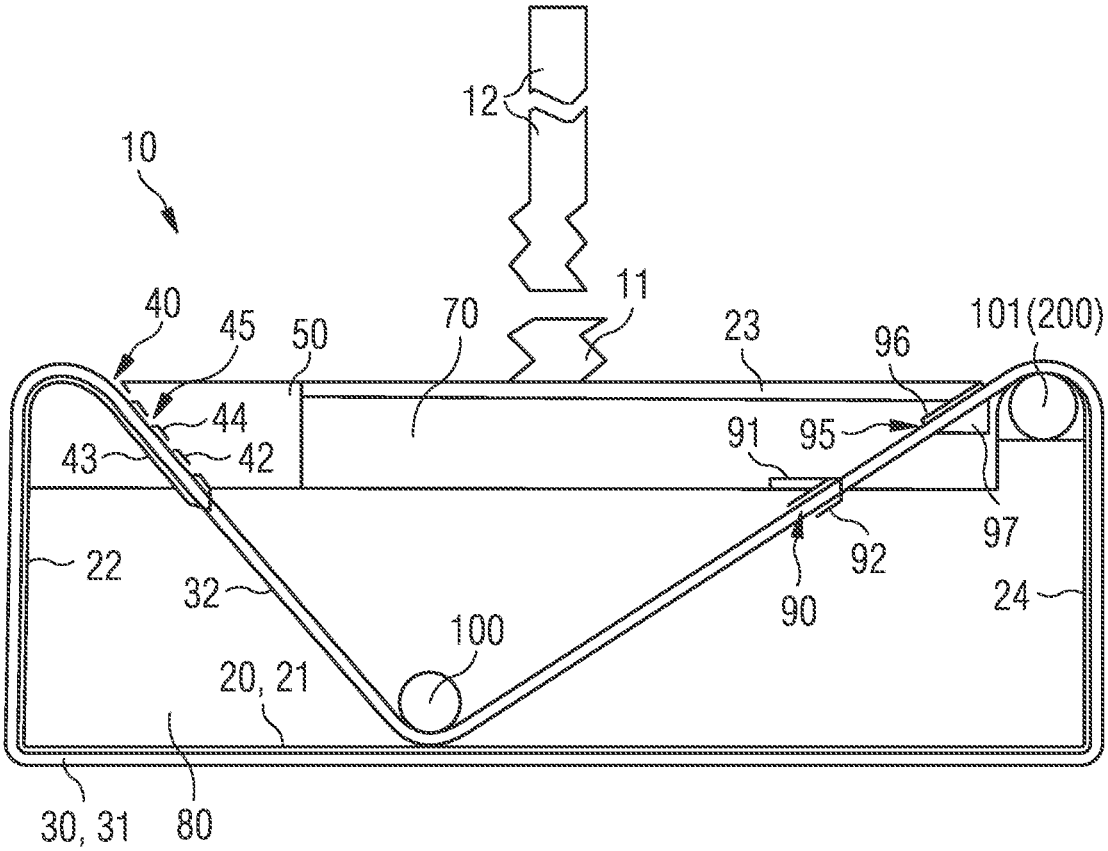
12
10
11
40
45
50
70
23
96
101(200)
44
91
95
43
42
97
22
92
32
90
24
100
20, 21
30, 31
80

WIPING MOP

CROSS-REFERENCE TO RELATED APPLICATIONS

This application claims priority to, and benefit of, European Patent Application No. 20 180 101.6, filed Jun. 15, 2020, which is hereby incorporated by reference.

BACKGROUND

The present invention relates to a wiping mop.

During use of a wiping mop, dirt particles are taken up from a surface to be cleaned such as tiles, parquet flooring, flagstones, linoleum etc. by a wiping element. The wiping element preferably comprises a robust, soft and thick material (e.g. a nonwoven, a foam, a sponge or a microfibre cloth). In the course of using the wiping element, this material becomes dirty since dirt particles taken up from the surface to be cleaned are deposited thereon and therein.

DESCRIPTION OF THE PRIOR ART

In the prior art this problem is usually solved by periodically exchanging the wiping element of the wiping mop and/or cleaning it in in suitable manner in an external cleaning bath. Examples for this known procedure are found in the prior art, e.g. in DE 10 2004 014 371 A1, DE 10 2005 019 624 B4 or DE 10 2005 024 745 B4. In addition, a device for scrubbing horizontal surfaces is known from U.S. Pat. No. 3,052,905 A which comprises a frame with side plates, a base plate, a front plate, a rear wall and an upper plate which is inclined upwards and backwards as well as a tank which is open at the top, which is supported between the side plates and the rear wall and adjoins the rear wall, wherein the upper plate begins at the front plate and ends at the open upper side of the tank, and which furthermore comprises a motor which is supported by the base plate in front of the tank and a transversely running drive roller which extends parallel to the rear plate and lies above the point of intersection of the tank and the upper plate.

A wiping mop according to the preamble of claim 1 is furthermore known from DE 10 2015 105 828 A1.

The aim of the present invention is to provide an alternative design for a wiping mop which has a compact design and in which a wiping element can be reliably cleaned of dirt particles during use of the wiping mop without it needing to be exchanged.

According to the invention, this object is achieved by a wiping mop according to claim 1. The further claims relate to advantageous embodiments of a wiping mop according to the invention and a method for use of the same.

Advantages and features of the present invention are obtained in particular from the following detailed description of preferred embodiments in conjunction with the appended figure.

DRAWINGS

FIG. 1 shows a schematic section through a wiping mop according to the invention.

DETAILED DESCRIPTION

The wiping mop 10 according to the invention comprises a housing 20. An anchoring mechanism 11 for receiving a handle 12 is attached to the upper side 23 of the housing 20. The handle 12 is used for guiding the wiping mop 10 over a surface to be cleaned.

For use of the wiping mop 10 as intended, this is provided with a wiping band 30 which is closed in itself, which is guided in a manner to be explained hereinafter around and through the housing 20. This wiping band 30 can consist of nonwoven materials or other materials particularly suitable for taking up dirt particles.

The housing 20 of the wiping mop 10 comprises a lower side 21, a first side wall 22 running approximately vertically upwards from the lower side 21, an upper side 23 running approximately horizontally and parallel to the lower side 21 and a second side wall 24 running from the upper side 23 approximately vertically downwards to the lower side 21.

An inlet slot 40 for the wiping mop 30 is provided on the upper side 23 of the housing 23.

A plurality of cavities separated from one another by partitions but connected to one another by passages are located inside the housing 20. As will be explained in the following, these are used to receive dirt particles, to receive wiping liquids or as passages for the wiping band 30 guided through the housing 20.

In particular, located inside the housing 20 in the region of the inlet slot 40 are a mechanical dirt separator (scraper pins 4), a coarse particle collecting chamber 50, a first (upper) tank 70 mounted approximately next to the coarse particle collecting chamber 50 and to be filled with wiping liquid and a second (lower) tank 80 mounted below the inlet slot 40, the coarse particle collecting chamber 50 and the first tank 70.

The second tank 80 is also to be filled with wiping liquid. In this case, the two tanks 70, 80 can be filled with the same wiping liquid. In the simplest case this is water with or without the addition of a cleaning agent concentrate. The concentration of the added cleaning agent can be the same or different in both tanks or different cleaning agents can also be used in both tanks 70, 80.

Passages are provided inside the housing in order to guide the wiping band 30 through the housing 20. Furthermore, a plurality of deflecting elements are provided on or in the housing 20 such as, for example, deflecting rollers 100, 101 which serve to deflect the wiping band 30 to be guided through the interior of the housing 20.

The operating mode of the wiping mop 10 according to the invention is as follows:

The wiping band 30 configured as an "endless band" which is closed in itself is guided around the lower side 21 of the housing, from there along the first side wall 22 and along a subsection of the upper side 23 as far as the entry slot 40, from there through the lower tank 80 and the upper tank 70, from there through an outlet slot 95 again out from the interior of the housing 20 around a deflecting element 101 along the second side wall 24 and from there again back to the lower side of the housing 21.

In this case, a movement of the wiping band 30 around and through the housing 20 is made possible on a path which is closed in itself which runs in the clockwise direction in the diagram shown in FIG. 1.

The part of the wiping band 30 which lies so that it faces away from the lower side 21 of the housing 20 is designated as outer side (cleaning side) 31 of the wiping band 30 and is the side which, when the wiping mop 30 is in use, is guided over a surface to be cleaned and comes directly in contact with dirt particles and removes or scrapes these from the surface to be cleaned.

The other side of the wiping band 30 which lies opposite the cleaning side 31 and abuts against the lower side 21 of the housing 20 is designated hereinafter as inner side 32 of the wiping band 30.

After a wiping process has been carried out, a part of the wiping band 30 abutting originally against the lower side 21 of the housing is guided through the inlet slot 40 into the interior of the housing 20. The advancement of the wiping band can be accomplished, for example, by manual turning of a drive wheel 200 connected to the deflecting roller 200. In an alternative embodiment, however, servomotors together with control electronics and operating elements can also be provided which provide for the desired advance of the wiping band 30.

The inlet slot 40 is formed by a first cheek 42 and a second cheek 43 which are opposite one another. The distance of the two cheeks 42, 43 from one another is dimensioned so that the cheeks come to rest relatively tautly against the inner side 32 and against the outer side 31 of the wiping band 30 guided therethrough but at the same time allow said wiping band to slide through the two cheeks 42, 43.

The first cheek 42 at the inlet slot 40 into the housing is provided with scraper pins 44 and with passage openings 45 which lead from the inlet chamber 40 to a coarse particle collecting chamber 50. The scraper pins 44 come in close contact with the outer side 31 of the wiping band 30 and act like a rake or a comb which, during movement of the wiping band 30 through the two cheeks 42, 43, scrape loose coarse dirt particles which have been taken up by the cleaning side 31 during wiping over a surface to be cleaned and adhere thereto, from the cleaning side 31 of the wiping band 30.

Located between the scraper pins 44 in the first cheek 42 are the passage openings 45 through which the dirt particles scraped by the scraper pins 44 from the cleaning side 31 of the wiping band 30 can pass into the coarse particle collecting chamber 50. As a result of the interplay of scraper pins 44 and passage openings 45, the two cheeks 42, 43 of the inlet slot 40 act as dirt separators for coarse particles.

The coarse particle collecting chamber 50 is provided with a flap or another suitable opening device (not shown) and preferably can be temporarily removed in its entirety from the housing 20. As a result, access is made possible to the interior of the coarse particle collecting chamber 50 and the dirt particles which collect in the interior thereof over the course of time during use of the wiping mop according to the invention can be removed from this and the coarse particle collecting chamber 50 can thus be emptied and cleaned again.

The lower ends of the first and second cheeks 42, 43 form a passage for the wiping band 30 in the lower tank 80. This lower tank 80 should also be filled with a wiping liquid. The wiping band 30 is guided from the lower end of the cheeks 43, 44 to a deflecting element 100 located substantially on the base of the lower tank 80, from where it is then guided in the lower tank 80 upwards again to a passage slot 90 between the lower tank 80 and the upper tank 70 located thereabove. This deflecting element 100 can be a freely rotatable roller. However, the deflecting element 100 can also be a rigidly vertical, substantially circular cylinder section over which the wiping band 30 slides. Optionally this deflecting element 100 can also be provided with a roughened surface at which further dirt particles can be scraped from the surface of the wiping band 30 in order to remain in the lower tank 80.

Since the wiping band 30 is firstly guided obliquely downwards and then obliquely upwards again, it covers a relatively long path in the wiping liquid located in the lower tank 80. In this case, the wiping liquid located in the lower tank 80 can act extensively on the dirt still located in the wiping band 30 after the coarse cleaning in the dirt separator explained above and release this from the wiping band 30.

When the wiping band 30 exits from the lower tank 80, this enters into the upper tank 70 located above the lower tank 80 through tightly spaced cheeks 91, 92 of a passage slot 90. The distance between the cheeks 91, 92 of this passage slot 90 is dimensioned so that the material of the wiping band 30 is somewhat compressed as it slides through the gap of the passage slot formed between the cheeks 91, 92. As a result, the wiping liquid taken up by the wiping band 30 in the lower tank 80 is substantially pressed out from the wiping band 30 and remains in the lower tank 80. At the same time, the dimensions of the passage slot 90 between the cheeks 91, 92 at the transition from the lower tank 80 into the upper tank 70 and the dimensions of the wiping band 30 in the transverse and longitudinal direction of the first passage slot 90 are selected so that the wiping band 30 guided between the cheeks 91, 92 seals the interior of the upper tank 70 located above the lower tank 80 with respect to the interior of the lower tank 80. As a result, the wiping liquid located in the lower second tank 80 and the wiping liquid located in the upper tank 70 scarcely mix with one another.

During use of the wiping mop 10 according to the invention, this has the result that in the course of time a larger quantity of dirt particles will accumulate in the lower tank 80 than in the wiping liquid in the upper tank 70 as a result of the wiping liquid taken up in the lower tank being pressed out in the passage slot 90.

The wiping band 30 wrung out at the second transition passage due to the contact pressure of the cheeks 91, 92 is washed out again in the upper tank 70 in a wiping liquid which is significantly less contaminated compared with the wiping liquid in the lower tank 80 with the result that the last fine dirt particles are also released from the wiping band 30. At the same time, the wiping band 30 in the upper tank 70 becomes saturated with the relatively clean second wiping liquid located therein. The upper tank 70 thus serves as a reservoir for a relatively clean second wiping liquid with which the wiping band 30 is wetted or impregnated after its exit from the housing 20 after fairly long usage of the wiping mop according to the invention.

Both the first and also the second tank 70, 80 have closable drain or filling openings (not shown) through which the wiping liquids contaminated by introduction of dirt particles in the course of use can be drained and fresh wiping liquids which are not yet contaminated can be poured in.

Located on the side of the upper tank 70 facing the upper side 23 of the housing 20 is an outlet slot 95 formed by cheeks 96, 97 and through which the wiping band 30 is guided from the interior of the housing 20 of the wiping mop 10.

These can again comprise two rigidly vertical cheeks 96, 97 similar to the cheeks 91, 92 in the passage slot 90 between the lower tank 80 and the upper tank 70. Preferably however the cheeks 96, 97 at the outlet slot 95 are mounted displaceably with respect to one another. In this case, for example, a first cheek 96 (left in FIG. 1) of the outlet slot 95 mounted at a greater distance from the second side wall 24 of the housing 20 is attached rigidly whereas the second cheek 97 of the outlet slot 95 comprises a wedge-shaped pressing jaw which is displaceable relative to the first cheek 96, whose position can be adjusted from outside by suitable aids. For example, a worm gear (not shown) can be provided which by turning an adjusting wheel by the operator ensures that the pressing jaw (second cheek 97) is displaced relative to the first cheek 96 with the result that the gap width between the first cheek 96 and the second cheek 97 is varied.

The contact pressure of the pressing jaw (second cheek 97) on the wiping band 30 can be regulated and therefore the degree with which the second wiping liquid taken up by the wiping band 30 in the upper tank 70 is wrung out again by varying the gap width between the first and the second cheek 96, 97 of the outlet slot 95. Thus, the residual moisture of the second wiping liquid remaining in the wiping band 30 after the exit from the outlet slot 90 can be controlled. The residual moisture can be matched as required to the surface condition of the surface to be cleaned with the wiping mop 10.

After exit of the wiping band 30 from the outlet slot 95, the wiping band 30 is guided around a deflecting roller 101 which ensures that the wiping band 30 again experiences a change in its direction of movement and then rests with its inner side on the second side wall 24, along which it is again guided downwards to the lower side 21 of the housing 20. Thus, the path of the wiping band 30 around and through the housing 20 of the wiping mop 10 guided in the clockwise direction in FIG. 1 is closed in itself.

In order to achieve the desired advance of the wiping band 30, the deflecting roller 101 can be designed as a manually rotatable deflecting roller if desired or as a deflecting roller which can be set in rotation by electric servomotors (not shown) in a higher-quality embodiment.

The structure of the housing 20 of the wiping mop 10 according to the invention thus comprises:

a dirt separator for coarse particles (scraper pins 44), a first (lower) tank 80 with a long path section of the wiping band 30 in the wiping liquid of the lower tank 80 for the thorough release of dirt particles, a passage slot 90 between lower and upper tank 80 and 70 which presses a large proportion of the wiping liquid from the lower tank 80 from the wiping band 30 before the wiping band 30 is guided into the wiping liquid in the upper tank 70 and an outlet slot 95 with variable slot width which allows the degree of moistening of the wiping band 30 with the wiping liquid from the upper tank 70 to be regulated.

As a result, a wiping mop is provided according to the invention which has a compact structure and allows a wiping band 30 to be used in continuous operation in which a relatively clean cleaning section of the wiping band 30 wetted with wiping liquid supplied from the upper tank 70 is provided as required by means of manual or motor-driven advancement of the wiping band.

Thus, larger areas can be cleaned rapidly and thoroughly with the wiping mop according to the invention without the wiping means located in the housing needing to be exchanged or without further external aids such as cleaning buckets filled with wiping agent or additional manual wringing-out aids for the wiping band needing to be provided.

REFERENCE LIST

10 Wiping mop
11 Anchoring mechanism for handle
12 Handle
20 Housing
21 Lower side of housing 20
22 First side wall of housing 20
23 Upper side of housing 20
24 Second side wall of housing 20
30 Wiping band
31 Cleaning side (outer side) of wiping band 30
32 Inner side of wiping band 30
40 Inlet slot
41 First cheek of inlet slot 40
42 Second cheek of inlet slot 40
44 Scraper pins
45 Passage openings in the first cheek 42
50 Coarse particle collecting chamber
70 First (upper) tank
80 Second (lower) tank
90 Passage slot
91 First cheek of passage slot 90
92 Second cheek of passage slot 90
95 Outlet slot
96 Pressing plate (first cheek of outlet slot 95)
96 Pressing jaws with worm gear (second cheek of outlet slot)
100 First deflecting device (first deflecting roller)
101 Second deflecting device (second deflecting roller)
200 Drive wheel

What is claimed is:

1. A wiping mop comprising a housing and a wiping element, wherein the wiping element is configured as a wiping band which is closed in itself, which can be guided on a path which is closed in itself around and through the housing, a first tank in the housing for receiving a first wiping liquid, a first deflecting device in the housing for the wiping band, as well as a passage slot which connects an interior of the first tank to an interior of a second tank, which is provided for receiving a second wiping liquid, a second deflecting element to deflect the wiping band from an upper side of the housing to a lower side of the housing, characterized in that the wiping band is guided through a mechanical dirt separator in the housing, wherein at least a part of the dirt separator has passage openings to a coarse particle collecting chamber in the housing through which dirt particles scraped by the wiping band on the dirt separator can pass into the coarse particle collecting chamber, and the first tank is attached underneath the coarse particle collecting chamber, the passage slot faces the upper side of the housing, an outlet slot for the wiping band is provided on a side of the second tank facing the upper side of the housing.

2. The wiping mop according to claim 1, characterized in that an anchoring mechanism for a handle for guiding the wiping mop is attached to the upper side of the housing.

3. The wiping mop according to claim 1, characterized in that at least the second deflecting element is a rotatable deflecting roller.

4. The wiping mop according to claim 3, characterized in that a servomotor is attached to the housing to set the deflecting roller actively in rotation.

5. The wiping mop according to claim 1, characterized in that the dirt separator consists of two opposite cheeks of which one forms an outer wall of the coarse particle collecting chamber.

6. The wiping mop according to claim 1, characterized in that a width of an outlet gap can be regulated.

7. The wiping mop according to claim 6, characterized in that the width of the outlet gap can be regulated by a relative movement of a pressing jaw which can be moved by a worm gear and a rigid pressing plate.

8. The wiping mop according to claim 1, characterized in that the coarse particle collecting chamber and/or the first tank and/or the second tank are detachably connected to the housing.

9. A method of using a wiping mop according to claim 1, the method comprising: using the wiping mop, wherein the same wiping liquid is used in the first tank and in the second tank.

10. The method according to claim 9, wherein the wiping liquid in the second tank is diluted by water with respect to the wiping liquid in the first tank.

11. The method according to claim 9, characterized in that an anchoring mechanism for a handle for guiding the wiping mop is attached to the upper side of the housing.

12. The method according to claim 9, characterized in that at least the second element is a rotatable deflecting roller.

13. The method according to claim 12, characterized in that a servomotor is attached to the housing to set the deflecting roller actively in rotation.

14. The method according to claim 9, characterized in that the dirt separator consists of two opposite cheeks of which one forms an outer wall of the coarse particle collecting chamber.

15. The method according to claim 9, characterized in that a width of an outlet gap can be regulated.

16. The method according to claim 15, characterized in that the width of the outlet gap can be regulated by a relative movement of a pressing jaw which can be moved by a worm gear and a rigid pressing plate.

17. The method according to claim 9, characterized in that the coarse particle collecting chamber and/or the first tank and/or the second tank are detachably connected to the housing.

* * * * *